US007448721B2

(12) United States Patent
Oshio et al.

(10) Patent No.: US 7,448,721 B2
(45) Date of Patent: Nov. 11, 2008

(54) INKJET PRINTING APPARATUS AND INKJET PRINTING METHOD

(75) Inventors: Naomi Oshio, Kawasaki (JP); Minoru Teshigawara, Yokohama (JP); Kiichiro Takahashi, Kawasaki (JP); Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 11/145,975

(22) Filed: Jun. 7, 2005

(65) Prior Publication Data

US 2005/0270313 A1 Dec. 8, 2005

(30) Foreign Application Priority Data

Jun. 8, 2004 (JP) ..... 2004-170448

(51) Int. Cl.
*B41J 2/165* (2006.01)

(52) U.S. Cl. ..... 347/23

(58) Field of Classification Search ..... 347/23
See application file for complete search history.

(56) References Cited

U.S. PATENT DOCUMENTS

| | | | | |
|---|---|---|---|---|
| 4,723,129 | A * | 2/1988 | Endo et al. | 347/56 |
| 5,896,143 | A | 4/1999 | Matsui et al. | |
| 6,345,878 | B1 | 2/2002 | Kanaya | 347/23 |
| 6,565,184 | B1 | 5/2003 | Numata et al. | 347/23 |
| 6,663,216 | B2 | 12/2003 | Kanaya | 347/23 |
| 6,808,247 | B2 | 10/2004 | Kawatoko et al. | |
| 2003/0063177 | A1 | 4/2003 | Yoshimura et al. | |
| 2004/0085391 | A1 | 5/2004 | Kanaya et al. | |

FOREIGN PATENT DOCUMENTS

| | | |
|---|---|---|
| EP | 0 842 779 | 5/1998 |
| JP | 8-197744 | 8/1996 |
| JP | 8-290562 | 11/1996 |
| JP | 10-278299 | 10/1998 |
| JP | 11-157101 | 6/1999 |
| JP | 2003-039693 | 2/2003 |
| JP | 2003-136755 | 5/2003 |

OTHER PUBLICATIONS

Japanese Office Action dated Apr. 9, 2007, issued in Japanese patent application No. 2004-170450, and English translation.
Japanese Office Action dated Apr. 9, 2007, issued in corresponding Japanese patent application No. 2004-170448, and English translation.

* cited by examiner

*Primary Examiner*—Julian D Huffman
(74) *Attorney, Agent, or Firm*—Fitzpatrick, Cella, Harper & Scinto

(57) ABSTRACT

In an inkjet printing apparatus having a plurality of printing modes with different scanning speeds, first and second preliminary discharge performing positions are provided within the moving area of a carriage as positions where preliminary discharge is performed to cause a printhead to discharge ink irrespective of printing, and a combination of positions where preliminary discharge is performed is set from the first and second preliminary discharge performing positions in accordance with the scanning speed in a set printing mode. This makes it possible to execute preliminary discharge at intervals within necessary intervals even if the scanning speed is decreased when high resolution printing is performed.

3 Claims, 5 Drawing Sheets

INKJET PRINTING APPARATUS AND INKJET PRINTING METHOD

FIELD OF THE INVENTION

The present invention relates to an inkjet printing apparatus and inkjet printing method and, more particularly, to control of preliminary discharge which causes a printhead to discharge ink irrespective of printing in an inkjet printing apparatus designed to perform printing by scanning, on a printing medium, a carriage on which inkjet printhead which discharges ink is mounted.

The present invention can be applied to all devices that use various kinds of printing media such as paper, cloth, leather, unwoven fabric, and metal. Specific devices to which the present invention can be applied include office equipment such as printers, copying machines, and facsimile apparatuses, industrial production machines, and the like.

BACKGROUND OF THE INVENTION

As data output apparatuses of word processors, personal computers, facsimile machines and so forth, printers capable of printing desired information such as texts and images on a sheet-type printing medium, e.g., paper, film and the like, are widely utilized.

Although various printing methods are available for such printers, recently an inkjet printing method has particularly attracted attention because of its capability to perform non-contact printing on a printing medium such as paper, ease of color printing, and low noise. Moreover, for a configuration of such printer, in general a serial printing method is widely adopted because of its low cost and ease of downsizing. According to the serial printing method, a printhead discharging ink in accordance with desired printing data is attached to a carriage and printing is performed by reciprocally scanning the carriage in a direction crossing to the conveyance direction of the printing medium (e.g., paper).

The inkjet printing scheme is designed to print on a printing medium by discharging small ink droplets using various kinds of ink discharge methods such as an electrostatic suction scheme implemented by the application of high voltages, a piezoelectric scheme of mechanically vibrating or displacing ink (colored ink) by using piezoelectric elements, and a thermal scheme using the pressure generated when ink forms bubbles as it is heated. This scheme produces little noise during printing, and allows high resolution, high speed printing by using a printhead having ink orifices formed at a high density. Printing apparatuses using such an inkjet printing scheme are in widespread use even in homes. It has therefore become popular that photos taken by digital cameras are printed by inkjet printing apparatuses.

As digital cameras have improved in function and have been able to take pictures with higher definition, inkjet printing apparatuses which output images have been required to print with higher resolution (density). In order to print with high resolution, it is effective to finely arrange small dots on a printing medium by further reducing the size of ink droplets to be discharged or improve the landing accuracy of ink droplets by decreasing the scanning speed.

On the other hand, the user's need to print at high speed is strong. High speed printing may be realized by, for example, increasing the scanning speed of a printhead or increasing the area where printing can be done by one scanning for printing by increasing the number of nozzles. However, as the scanning speed of the printhead increases, it becomes more difficult to land a discharged ink droplet at a desired position, resulting in a deterioration in landing accuracy. In addition, for example, the vibration of the printing apparatus due to the scanning of the printhead becomes stronger, and large noise is made when the printhead is scanned.

As described above, recently, users have strongly demanded to perform high resolution printing and shorten printing time. It is therefore necessary to provide a printing apparatus which can satisfy these two demands. However, since the methods of satisfying these two demands are contradictory to each other, it is difficult to satisfy the two demands at the same time. The market, however, is demanding an inkjet printing apparatus which satisfies these two demands and suppresses vibration and noise.

An inkjet printing apparatus is designed to print by discharging liquid ink toward a printing medium through small holes (nozzles) formed in the printhead. It is, however, known that since ink is a liquid, when the nozzles are exposed to the atmosphere, the ink in the nozzles increases in viscosity and solidifies.

As ink increases in viscosity and solidifies, a discharge failure, e.g., the occurrence of the landing position offset of an ink droplet or a non-discharge state in which no ink droplet is discharged, occurs, resulting in a deterioration in the quality of a printed image. In order to prevent this, the inkjet printing apparatus has a recovery mechanism for setting the apparatus in a good discharge state. This mechanism performs suction recovery operation of producing negative pressure in the printhead by suction or pressurization, thereby discharging ink in the printhead, or preliminary discharge operation of discharging ink irrespective of printing. Such recovery operation is performed when a predetermined period of time has elapsed while the nozzles are exposed to the atmosphere. In this operation, ink which has increased in viscosity and solidified is discharged outside the nozzles.

Controlling the intervals of this preliminary discharge makes it possible to properly discharge ink under any conditions. In this case, the predetermined period of time is arbitrarily set in accordance with ink, a printhead, and an inkjet printing apparatus. If, for example, the mass (volume) of ink droplets to be discharged is small, since the kinetic energy applied to ink to discharge it is small, the ink cannot be discharged once it increases in viscosity. For this reason, ink whose viscosity has increased lightly must be discharged by preliminary discharge while the evaporation of the ink is small in amount. Therefore, as the mass of ink droplets decreases, the preliminary discharge intervals must be shortened.

In general, preliminary discharge is performed at a predetermined position, e.g., a cap which is provided near the home position and also used for suction recovery or a preliminary discharge port provided on the opposite side of the printing area to the home position (for example, Japanese Patent Laid-Open No. 10-278299).

Caps for suction recovery are indispensable for inkjet printing apparatuses, and hence any printing apparatuses have them. In contrast, a preliminary discharge port is preferably provided with a member which absorbs ink, and is not used for anything other than preliminary discharge, and hence some printing apparatus is designed without a preliminary discharge port in consideration of the cost and space required for the printing apparatus. With this arrangement, preliminary discharge is performed only at the preliminary discharge port.

In addition, since a cap has a mechanism for suction recovery, ink (including pigment ink) discharged by preliminary discharge can be discharged outside the cap. In contrast, a preliminary discharge port often has no suction mechanism. If, therefore, pigment ink is preliminarily discharged through the preliminary discharge port, the pigment ink solidifies into stalactite-like clusters and is deposited. As the degree of deposition increases, the deposit comes into contact with the discharge surface of the printhead or the like. This damages the discharge surface or the like.

For the above reason, a printing apparatus which discharges pigment ink is designed to mainly perform preliminary discharge only at the cap.

As described above, it is very difficult to satisfy both the demands for high speed printing and high resolution printing. In order to realize high resolution, for example, the mass of ink to be discharged needs to be minimized, and the landing accuracy of ink droplets (dots) needs to be increased.

If, however, the mass of ink to be discharged is decreased, a discharge failure tends to occur due to an increase in viscosity of ink and its solidification described above, and the lading accuracy tends to deteriorate because of small kinetic energy and the like. In order to satisfy both the demands for high speed printing and high resolution printing while solving these problems, different printing operations are performed in accordance with different printing modes to achieve the respective purposes.

For example, the printing mode for plain paper on which document data such as a text is to be mainly printed is set to a high speed mode giving priority to printing speed, and the printing mode for glossy paper on which image data such as a photo is to be printed is set to a high resolution mode. In the high speed mode, printing in each printing area is completed by one scanning operation. In the high resolution mode, a method of performing control to realize multi-pass printing is known, in which data to be printed by one scanning operation is decimated, and printing in each printing area is completed by a plurality of scanning operations (for example, Japanese Patent Laid-Open No. 08-290562). The method of performing multi-pass printing while decimating print data in accordance with the printing mode is easier to control than the method of changing the scanning speed, and hence is generally used.

In order to further improve the printing quality, however, it is insufficient to simply perform multi-pass printing. It is also necessary to decrease the scanning speed. Consider a case in which the scanning speed is decreased.

Decreasing the speed of a carriage will increase the intervals at which preliminary discharge can be executed. This method is therefore difficult to apply to an inkjet printing apparatus which uses pigment ink. This is because, in the printing apparatus using pigment ink, preliminary discharge is performed only at the cap near the home position as described above, but the shortest time during which preliminary discharge can be executed cannot be set to be less than the time required for the printhead to reciprocate once.

For example, in the normal printing mode, it takes 0.75 sec for the printhead to reciprocate once. If the preliminary discharge intervals required for the printhead are 3 sec, preliminary discharge is performed once per three reciprocations. Likewise, if the preliminary discharge intervals required for the printhead are 1.3 sec, preliminary discharge must be done every time the printhead reciprocates once.

In contrast to this, if the preliminary discharge intervals required for the printhead are 1.3 sec, the printhead needs to be scanned at a speed that allows the printhead to reciprocate once within 1.3 sec.

In the high resolution mode, if the scanning speed is decreased, the time required for the printhead to reciprocate once is prolonged, and may exceed the preliminary discharge intervals required for the printhead. Assume that it takes 0.75 sec for the printhead to reciprocate once in the normal printing mode, and the preliminary discharge intervals required for the printhead are 1.3 sec. In this case, if the scanning speed in the high resolution mode is decreased to ½ that in the normal printing mode, the time required for the carriage to reciprocate once is 1.5 sec, which is longer than the preliminary discharge intervals required for the printhead.

The prolongation of the shortest time during which preliminary discharge can be executed is also disadvantageous when a printhead which discharges ink droplets with a small mass is used. This is because, as described above, as the mass of ink droplets decreases, kinetic energy decreases, and ink which has increased in viscosity upon evaporation tends to adhere to the discharge surface, resulting in the need to shorten the preliminary discharge intervals.

As described above, as the scanning speed is decreased in performing high resolution printing, if the mass of ink droplets is small, it is difficult to execute preliminary discharge at intervals within necessary intervals.

SUMMARY OF THE INVENTION

The present invention can execute preliminary discharge at intervals within necessary intervals even if the scanning speed is decreased when, for example, high resolution printing is performed.

According to an aspect of the present invention, there is provided an inkjet printing apparatus which performs printing by scanning, on a printing medium, a carriage on which an inkjet printhead which discharges ink is mounted, and has a plurality of printing modes in which the carriage is scanned at different scanning speeds, comprising preliminary discharge means for performing preliminary discharge to cause the printhead to discharge ink irrespective of printing, a first preliminary discharge performing position and a second preliminary discharge performing position at which the preliminary discharge is performed within a moving area of the carriage, and preliminary discharge position setting means for setting a position or a combination of positions where preliminary discharge is performed by the preliminary discharge means, from the first preliminary discharge performing position and the second preliminary discharge performing position in accordance with the scanning speed of the carriage in a set printing mode.

According to the present invention, in an inkjet printing apparatus which performs printing by scanning, on a printing medium, a carriage on which an inkjet printhead which discharges ink is mounted, and has a plurality of printing modes with different scanning speeds, there are provided first and second preliminary discharge performing positions within the moving area of the carriage as positions at which preliminary discharge is performed to cause the printhead to discharge ink irrespective of printing, and a combination of positions at which preliminary discharge is performed is set from the first and second preliminary discharge performing positions in accordance with the scanning speed of the set printing mode.

This makes it possible to execute preliminary discharge at intervals within necessary intervals even if the scanning speed is decreased when, for example, high resolution printing is performed.

Even in an inkjet printing apparatus using a printhead which discharges ink droplets with a small mass, therefore, higher definition printing can be done while the occurrence of a discharge failure is prevented.

The preliminary discharge position setting means may make setting to perform preliminary discharge at both the first preliminary discharge performing position and the second preliminary discharge performing position when the scanning speed is not more than a predetermined speed, and may make setting to perform preliminary discharge only at the first preliminary discharge performing position when the scanning speed is higher than the predetermined speed.

A first printhead which discharges pigment ink and a second printhead which discharges dye ink may be mounted on the carriage, and the preliminary discharge position setting means makes setting for the first printhead to perform preliminary discharge only at the first preliminary discharge performing position irrespective of the scanning speed.

The first preliminary discharge performing position may be a position where recovery means for executing recovery processing for the printhead near a home position of the printhead is arranged, and the second preliminary discharge performing position may be set on an opposite side to the first preliminary discharge performing position in the moving area of the carriage.

The printhead may be a printhead which discharges ink by using thermal energy, and comprises a thermal energy transducer which generates thermal energy to be applied to ink.

In order to achieve the above object, according to another aspect of the present invention, there is provided an inkjet printing apparatus which performs printing by scanning, on a printing medium, a carriage on which an inkjet printhead which discharges ink is mounted, and has a plurality of printing modes in which the carriage is scanned at different scanning speeds, comprising preliminary discharge means for performing preliminary discharge to cause the printhead to discharge ink irrespective of printing, a control unit which controls preliminary discharge operation by the preliminary discharge means, and a plurality of preliminary discharge receiving portions which receive ink discharged from the printhead by the preliminary discharge operation within a moving area of the carriage, wherein the control unit makes a preliminary discharge receiving portion used when printing is performed in a predetermined printing mode of the plurality of printing modes differ from a preliminary discharge receiving portion used when printing is performed in a printing mode different from the predetermined printing mode.

Note that the present invention can also be achieved by an inkjet printing method corresponding to the above inkjet printing apparatus, a computer program which causes a computer to execute the inkjet printing method, or a storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that each element in the following embodiments is not intended to limit the scope of the invention, but is described only as an example.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "nozzle" should be interpreted as any combination of a discharge opening, a channel communicating thereto and an energy-generating element used for discharging ink, without annotation.

<Outline of Inkjet Printing Apparatus>

An outline of an inkjet printing apparatus according to the present invention, which is common to the following embodiments, will be described first.

Figure 1:
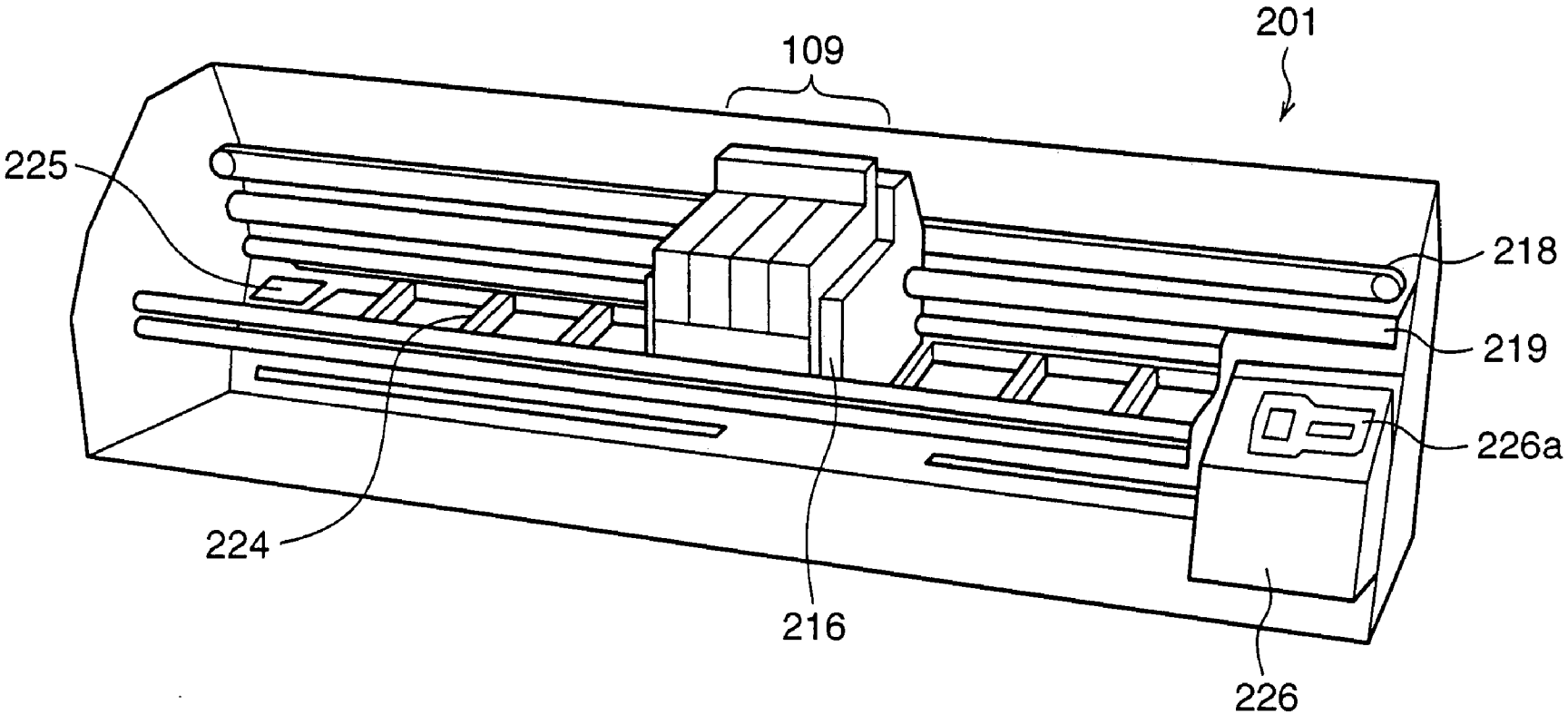
FIG. 1 is a schematic perspective view showing the arrangement of the main part of an inkjet printing apparatus which can be applied to the present invention.
Figure 2:
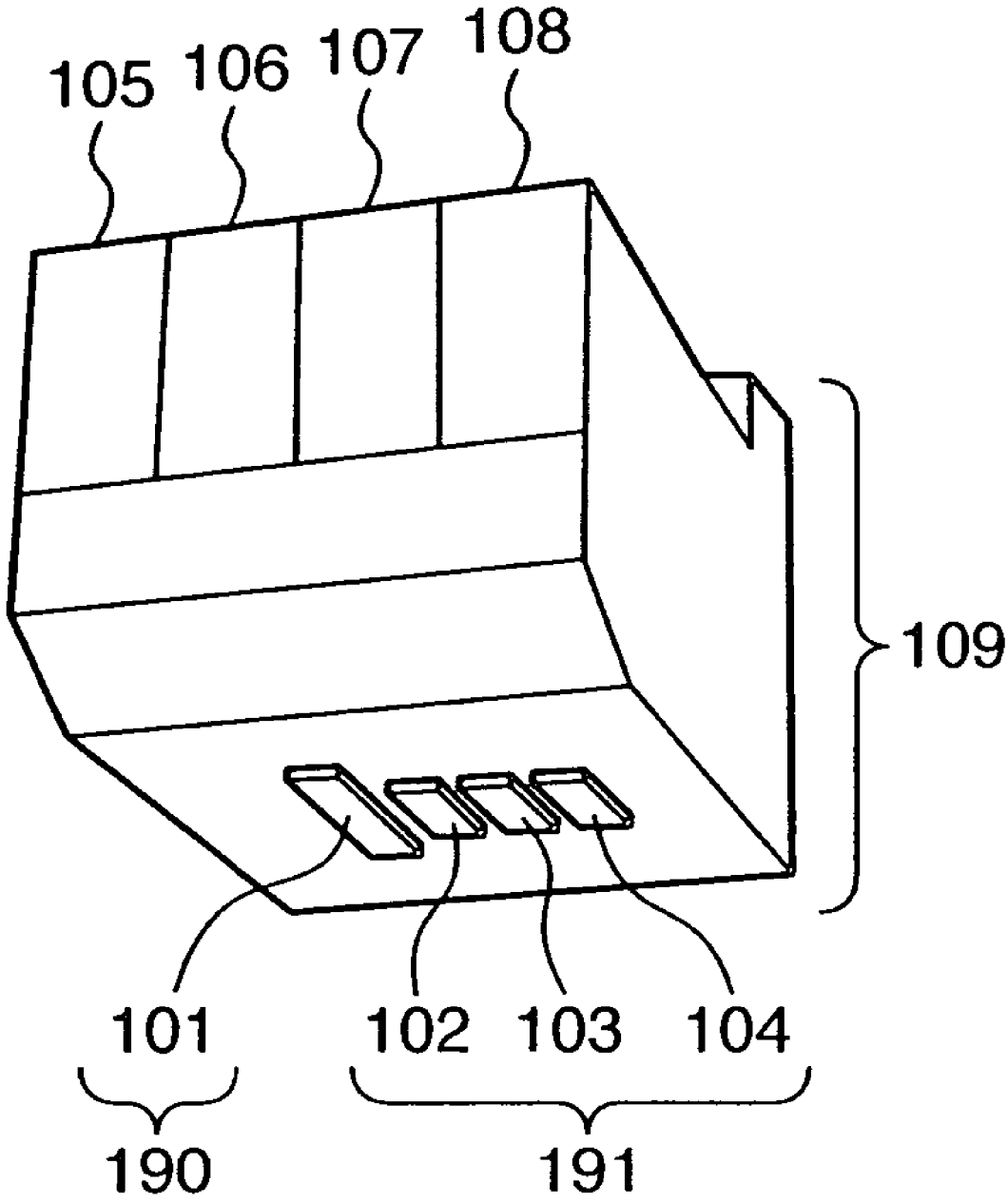
FIG. 2 is a perspective view showing the schematic arrangement of an inkjet printhead cartridge in FIG. 1.

FIG. 1 is a perspective view showing the arrangement of the main part of the inkjet printing apparatus according to the present invention. FIG. 2 is a perspective view showing the schematic arrangement of the head cartridge of the inkjet printing apparatus in FIG. 1.

Referring to FIG. 2, reference numerals 101 to 104 denote thermal inkjet printheads which discharge inks to a printing medium by using bubbles produced by thermal energy. Each printhead has a nozzle array comprising a plurality of nozzles. Reference numeral 190 denotes a printhead unit which discharges black pigment ink; and 191, a printhead unit which discharges C (Cyan), M (Magenta), and Y (Yellow) dye inks and is formed by integrating the inkjet printheads 102 to 104 into one unit.

According to the form shown in FIG. 2, reference numerals 105 to 108 denote ink tanks respectively containing black pigment ink, cyan dye ink, magenta dye ink, and yellow dye ink; and 109, an inkjet printhead cartridge integrated with the inkjet printheads 101 to 104. Each of the ink tanks 105 to 108 can be detachably mounted in the inkjet printhead cartridge 109.

In the inkjet printing apparatus shown in FIG. 1, since the quality of characters printed by dye ink on plain paper is poor, pigment ink is used as black ink to improve the quality of characters printed in black on plain paper. Note that when an image such as a photo is to be printed on special paper, printing is performed by using only dye ink without using this pigment ink. Such an ink set can be arbitrarily set in accordance with the characteristics of the apparatus body. That is, the numbers and colors of dye inks and pigment inks are not specifically limited.

In addition, referring to FIG. 1, reference numeral 201 denotes an inkjet printing apparatus body. When the inkjet printhead cartridge 109 is mounted on a carriage 216 which detachably holds the cartridge, the inkjet printhead cartridge 109 is electrically and mechanically connected to the inkjet printing apparatus body 201.

Referring to FIG. 1, when the inkjet printhead cartridge 109 is mounted on the carriage 216, the nozzle arrays of the inkjet printheads 101 to 104 face the printing surface of a printing medium conveyed onto a platen 224. The carriage 216 is coupled to a portion of a driving belt 218 which transfers the driving force of a driving motor (304 in FIG. 3), and is made slidable on a guide shaft 219. This makes it possible for the inkjet printheads 101 to 104 to reciprocate throughout the total width of the printing medium.

By driving the inkjet printheads 101 to 104 during this reciprocal movement in accordance with reception data, an image is printed on the printing medium. Every time this main scanning operation is performed once, sub-scanning is performed to convey the printing medium by a predetermined amount.

Reference numeral 226 denotes a head recovery device, which is placed at one end of the moving path of the inkjet printheads 101 to 104, e.g., near the home position. The head recovery device 226 is operated by the driving force of a motor through a transfer mechanism to cap each of the inkjet printhead units 190 and 191. As a cap portion 226*a* of the head recovery device 226 caps the inkjet printhead units 190 and 191, ink suction (suction recovery) is performed by a suction means (suction pump) provided in the head recovery device 226. When printing is complete, capping by the cap portion 226*a* prevents the evaporation of ink from the inkjet printhead units 190 and 191 and protects the surfaces (discharge surfaces) of the inkjet printhead units.

In the moving area of the carriage, a preliminary discharge port 225 is provided on the opposite side to the position of the head recovery device 226 (cap portion 226*a*). As will be described later, in the high resolution printing mode with a low scanning speed, control is performed to perform preliminary discharge at the preliminary discharge port 225 as well as at the cap portion 226*a*.

Figure 3:
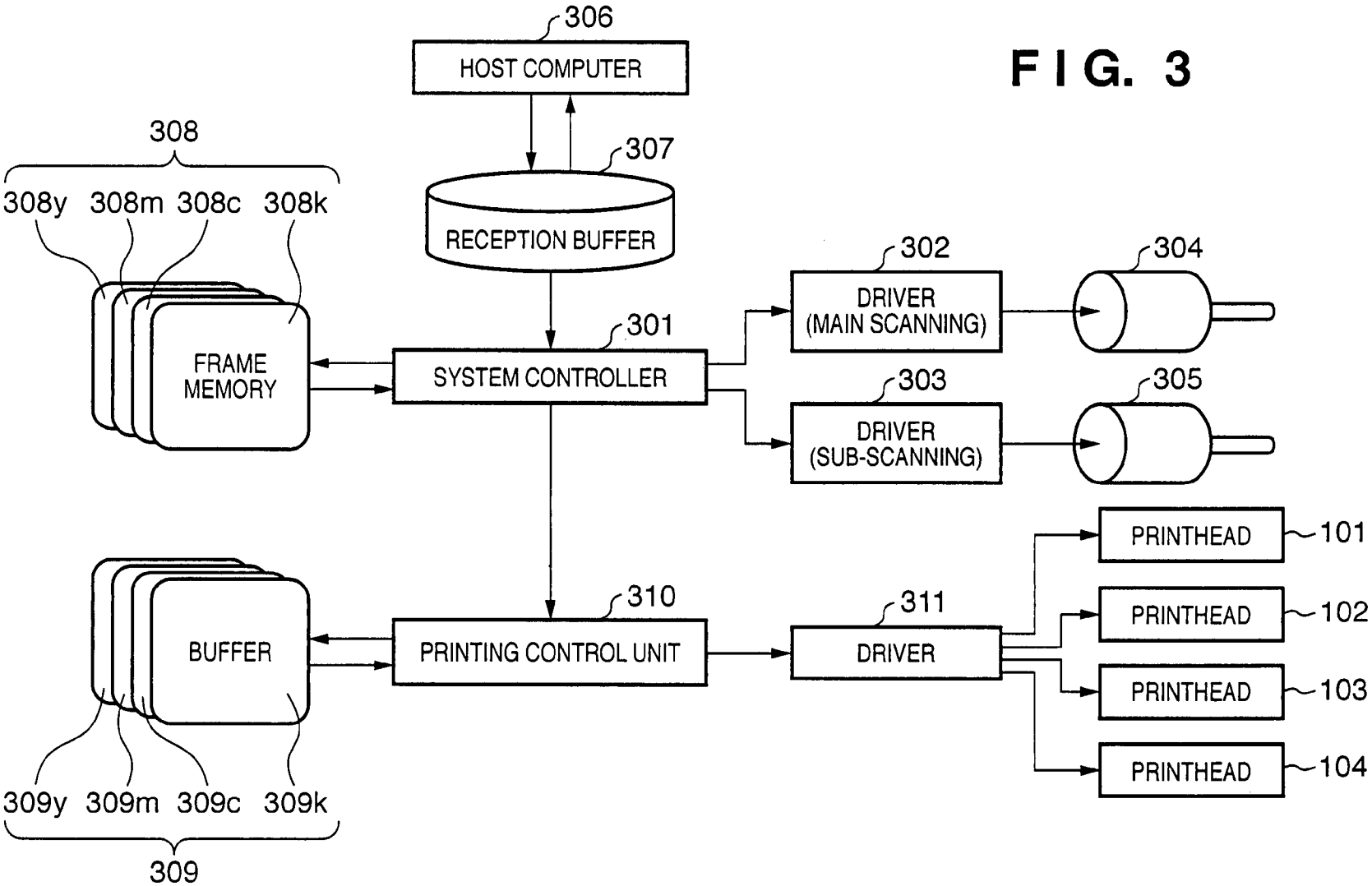
FIG. 3 is a block diagram showing the arrangement of a control system in the inkjet printing apparatus in FIG. 1.

FIG. 3 is a block diagram showing the arrangement of a control system in this inkjet printing apparatus.

Referring to FIG. 3, reference numeral 301 denotes a system controller which controls the overall apparatus and incorporates a microprocessor (MPU), a ROM in which control programs are stored, a RAM used as a work area when the microprocessor performs processing, and the like. The system controller 301 controls preliminary discharge in accordance with a control program, and designates the timing of the execution of preliminary discharge to a printing control unit 310 (to be described later). Note that main control of the inkjet printing apparatus according to the present invention, including this control of preliminary discharge and the like, is executed under the control of a host computer 306.

Reference numeral 302 denotes a driver which drives/controls a motor 304 for moving (main scanning) the carriage 216 on which the inkjet printhead cartridge is mounted. According to the present invention, the speed of the carriage 216 is decreased by controlling the driver 302. Reference numeral 303 denotes a driver in the sub-scanning direction, which drives/controls a motor 305 for conveying a printing medium in the sub-scanning direction.

The host computer 306 serving as a host device transfers print data and the like to the printer of the present invention. Reference numeral 307 denotes a reception buffer for temporarily storing data received from the host computer 306. The reception buffer 307 keeps storing the data until the system controller 301 reads in the data.

Reference numeral 308 (308*k*, 308*c*, 308*m*, 308*y*) denotes a frame memory which is provided for each ink color (black, cyan, magenta, and yellow) to convert print data into image data, and has a memory size necessary to print in a predetermined area; and 309 (309*k*, 309*c*, 309*m*, 309*y*), a buffer for temporarily storing print data corresponding to one scanning operation of the inkjet printhead. Such buffers are respectively provided for the respective ink colors (black, cyan, magenta, and yellow). The buffer 309 is used to store only print data corresponding to one scanning operation, which the host computer 306 has created by color conversion, density correction, and binarization processing and transmitted.

The printing control unit 310 controls the printheads under the control of the system controller 301. In controlling preliminary discharge according to the present invention, the printing control unit 310 receives a command from the system controller 301 described above and controls a driver 311 (to be described later). The driver 311 drives the inkjet printheads 101, 102, 103, and 104 to discharge the respective inks (black, cyan, magenta, and yellow inks). The driver 311 is controlled by a control signal from the printing control unit 310, and causes the inkjet printheads 101, 102, 103, and 104 to perform preliminary discharge.

First Embodiment

The first embodiment of the present invention in the inkjet printing apparatus having the above arrangement will be described below.

This embodiment is directed to an inkjet printing apparatus in which a printhead for discharging black pigment ink and printheads for discharging color dye inks are mounted on a carriage, and can perform high resolution printing for the printing of an image such as a photo by making the mass of ink droplets of the color dye inks smaller than that of ink droplets of black pigment ink.

In this manner, the printhead which discharges pigment ink is designed to discharge ink droplets larger than those discharged from the printheads which discharge dye ink. The necessary preliminary discharge intervals for the printhead which discharges pigment ink are set to be longer than those for the printheads which discharge dye ink.

This apparatus has three printing modes, i.e., a high speed printing mode, normal printing mode, and high resolution mode, and changes the scanning speed of the printheads in the respective modes. In the high speed printing mode, the carriage is moved at the highest speed so as to give priority to printing speed. In the high resolution mode, control is performed to decrease the scanning speed so as to maximize the printing quality. In the normal printing mode, the scanning speed is set between that in the high speed printing mode and that is the high resolution mode.

Table 1 shows the speeds (scanning speeds) of the carriage in the constant speed ranges, the times required for one reciprocation from the cap position, and the times required for movement from the cap position to the preliminary discharge port position on the opposite side to the cap position in the three printing modes in this embodiment.

TABLE 1

| | High Speed Printing Mode | Normal Printing Mode | High resolution Mode |
|---|---|---|---|
| Carriage Speed in Constant Speed Range | 30 inches/s | 20 inches/s | 10 inches/s |
| Time Required for Reciprocation to Cap Position | 0.5 sec | 0.75 sec | 1.5 sec |
| Time Required for Movement to Preliminary Discharge Port Position | 0.25 sec | 0.375 sec | 0.75 sec |

As shown in Table 1, the carriage speeds (scanning speeds) in the constant speed ranges are 30 inches/s in the high speed printing mode, 20 inches/s in the normal printing mode, and 10 inches/s in the high resolution mode. With reference to the normal printing mode, the scanning speed in the high speed printing mode is 1.5 times, and the scanning speed in the high resolution mode is ½. Therefore, the times required for one reciprocation to the cap position, with reference to 0.75 sec in the normal printing mode, are ⅔ times in the high speed printing mode, i.e., 0.5 sec, and two times in the high resolution mode, i.e., 1.5 sec. The times required for movement in the scanning direction to a preliminary discharge port 225 located on the opposite side to a cap portion 226*a* are ½ those required for one reciprocation to the cap position, i.e., 0.25 sec, 0.375 sec, and 0.75 sec in the respective modes.

As described above, this embodiment is configured to perform printing by using black pigment ink and color dye inks. The preliminary discharge intervals necessary for each printhead for color ink, which discharges ink droplets with a small mass, are set to 1.3 sec. Even in the high resolution mode in which the scanning speed is low, control is performed to execute preliminary discharge at both the cap and the preliminary discharge port at intervals shorter than the preliminary discharge intervals.

Figure 4:
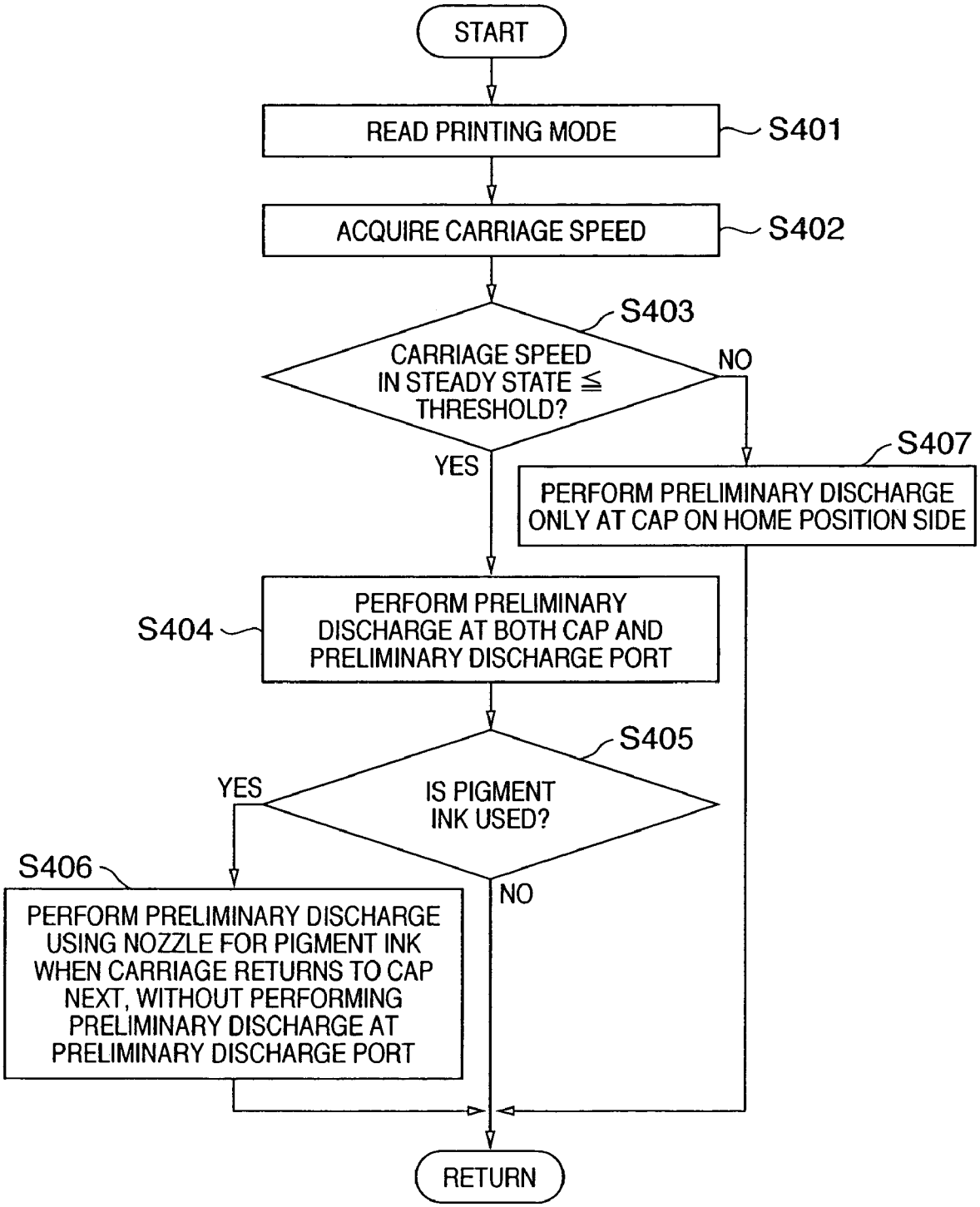
FIG. 4 is a flowchart showing a sequence for preliminary discharge control in the first embodiment.

Preliminary discharge control in this embodiment will be described below with reference to the flowchart of FIG. 4. When a printing control unit 310 processes the timing of the execution of preliminary discharge and receives a signal for the execution of preliminary discharge, the flow for setting a combination of preliminary discharge positions is started.

First of all, the printing control unit 310 acquires a printing mode in step S401, and acquires the information of the carriage speed set in correspondence with the printing mode in step S402. In step S403, the printing control unit 310 determines whether the carriage speed is equal to or lower than a threshold speed corresponding to the above preliminary discharge intervals (1.3 sec).

If it is determined that the carriage speed is higher than the threshold speed (NO), the flow advances to step S407 to make setting to perform preliminary discharge only at the cap portion 226*a* on the home position side. This is because when the carriage speed is high, preliminary discharge on the cap side alone can satisfy the desired preliminary discharge intervals, and hence it is advantageous to perform preliminary discharge at the cap position where suction recovery processing can also be done.

If it is determined in step S403 that the speed of the carriage is lower than the threshold speed (YES), the flow advances to step S404 to make setting to perform preliminary discharge at both the cap portion 226*a* and the preliminary discharge port 225.

In step S405, it is determined whether or not pigment ink is used. As described above, pigment ink tends to be deposited, and hence preliminary discharge cannot be performed at the preliminary discharge port. If, therefore, YES in step S405, the flow advances to step S406 to make setting for the printhead using pigment ink to perform preliminary discharge at the cap, without performing preliminary discharge at the preliminary discharge port, when the carriage returns to the cap side next. As described above, in this embodiment, ink droplets discharged from the printhead which discharges pigment ink are larger in size (mass or capacitance) than those discharged from the printheads which discharge dye ink, and the preliminary discharge intervals necessary for the printhead which discharges pigment ink are longer than those necessary for the printheads which discharge dye ink. With regard to the printhead which discharges pigment ink, therefore, even if the carriage speed is set to be low or setting is made to perform preliminary discharge only at the cap position, no discharge failure occurs.

As described above, according to this embodiment, even if the scanning speed is set to be low when high resolution printing is performed, preliminary discharge is performed at intervals within desired predetermined intervals to obtain a high-definition printed image while preventing an increase in viscosity of ink and its solidification.

In addition, in the inkjet printing apparatus which prints by using pigment ink and dye ink, since setting is made to perform preliminary discharge of pigment ink only at the cap position, deposition of pigment ink at the preliminary discharge port can be prevented.

Second Embodiment

The second embodiment of the present invention will be described below. The second embodiment is directed to an inkjet printing apparatus similar to that of the first embodiment. A description of portions similar to those in the first embodiment will be omitted, and the characteristic portion of the second embodiment will be mainly described.

According to the first embodiment, in the inkjet printing apparatus which uses pigment ink and dye ink, when the speed of the carriage is low, setting is made to perform preliminary discharge at both the cap and the preliminary discharge port, and for the printhead which discharges pigment ink, setting is made to perform preliminary discharge only at the cap position.

Recently, various improvements have been made to pigment ink and inkjet printing apparatuses which discharge pigment ink, and methods of preventing and solving the problem of the solidification of ink have been proposed. Methods of preventing and solving the problem of the solidification of ink include, for example, a method based on a mechanical arrangement, a method using chemical agents such as a solvent which prevents ink from solidifying, and a method designed such that even if ink solidifies, no problem occurs.

The second embodiment can be equally applied to an inkjet printing apparatus which can prevent and solve the problem of the solidification of pigment ink and an inkjet printing apparatus which uses only dye ink.

Figure 5:
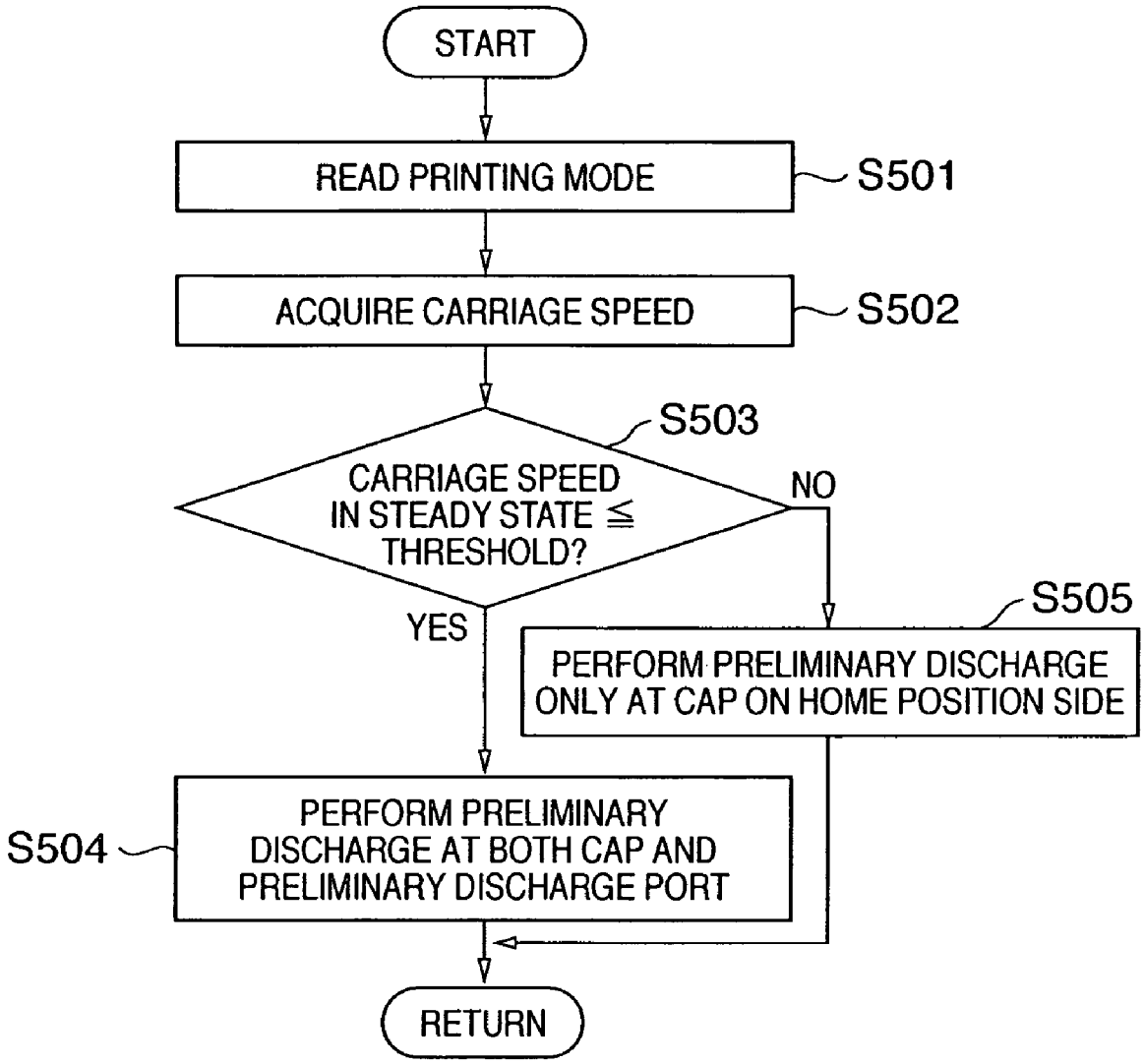
FIG. 5 is a flowchart showing a sequence for preliminary discharge control in the second embodiment.

Preliminary discharge control in this embodiment will be described below with reference to the flowchart of FIG. 5. When a printing control unit 310 processes the timing of the execution of preliminary discharge and receives a signal for the execution of preliminary discharge, the flow for setting a combination of preliminary discharge positions is started.

First of all, the printing control unit 310 acquires a printing mode in step S501, and acquires the information of the carriage speed set in correspondence with the printing mode in step S502. In step S503, the printing control unit 310 determines whether the carriage speed is equal to or lower than a threshold speed corresponding to the above preliminary discharge intervals.

If it is determined that the carriage speed is higher than the threshold speed, the flow advances to step S505 to make setting to perform preliminary discharge only at the cap position on the home position side. If it is determined that the speed of the carriage is lower than the threshold speed, the flow advances to step S404 to make setting to perform preliminary discharge at both the cap portion 226*a* and the preliminary discharge port 225.

As described above, according to preliminary discharge control in this embodiment, the processing (S405 and S406) associated with the use of pigment ink in preliminary discharge control in the first embodiment is omitted. Even if the scanning speed is set to be low when high resolution printing is performed, preliminary discharge is performed at intervals within desired preliminary discharge intervals, and a high resolution printed image can be obtained while an increase in viscosity of ink and its solidification are prevented.

Other Embodiment

The above embodiments are configured to determine preliminary discharge positions in accordance with the speed of the carriage. Assume that the printing width by which printing is performed by one printing/scanning operation is small, and the carriage can be reciprocally scanned. In this case, even if the carriage speed is low, preliminary discharge may be performed only at one position (e.g., at the cap on the home position side). A printing width is obtained from print data in previous printing/scanning operation and subsequent printing/scanning operation, and it is determined whether or not the time taken to perform printing at the carriage speed set for the printing width is less than preliminary discharge intervals. This makes it possible to determine preliminary discharge positions in accordance with the printing width and carriage speed in scanning operation. With this arrangement, when the printing width is short, wasteful scanning of the carriage can be reduced, and printing can be done at a higher speed.

Each embodiment described above has exemplified the thermal inkjet printing apparatus. However, the present invention can be applied to printing apparatuses using any ink discharge methods. For example, the present invention can be effectively applied to an inkjet printing apparatus based on a piezoelectric scheme.

In addition, the present invention can be applied to a multifunction apparatus or system comprising a plurality of devices including a device which implements a function corresponding to an inkjet printing apparatus.

Furthermore, the invention can be implemented by supplying a software program (a program corresponding to a flowchart shown in FIG. 4 or FIG. 5), which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-170448, filed Jun. 8, 2004, which is hereby incorporated by reference.

What is claimed is:

1. An inkjet printing apparatus which performs printing by bi-directionally scanning, over a printing medium, a carriage on which an inkjet printhead for discharging ink is mounted, the carriage being scanned at different scanning speeds in respective printing modes, the apparatus comprising:

preliminary discharge means for performing preliminary discharge;

a first preliminary discharge performing portion and a second preliminary discharge performing portion at which the preliminary discharge is performed within a scanning area of the carriage; and preliminary discharge portion setting means for setting a portion or a combination of portions where the preliminary discharge is performed by said preliminary discharge means, from the first preliminary discharge performing portion and the second preliminary discharge performing portion, in accordance with the scanning speed of the carriage in a set printing mode, wherein said preliminary discharge portion setting means sets the first and second preliminary discharge performing portions in a case that the scanning speed of the carriage is not more than a predetermined speed, and sets only the first preliminary discharge performing portion in a case that the scanning speed of the carriage is higher than the predetermined speed, and the second preliminary discharge performing portion is set on a side opposite to the first preliminary discharge performing portion in the scanning area of the carriage.

2. An inkjet printing apparatus which performs printing by bi-directionally scanning, over a printing medium, a carriage on which a first printhead for discharging pigment ink and a second printhead for discharging dye ink are mounted, the carriage being scanned at different scanning speeds in respective printing modes, the apparatus comprising:

a first preliminary discharge performing portion and a second preliminary discharge performing portion at which preliminary discharge is performed within a scanning area of the carriage;

preliminary discharge means for performing the preliminary discharge; and preliminary discharge portion setting means for setting a portion or a combination of portions where the preliminary discharge of the first and second printheads is performed by said preliminary discharge means, from the first preliminary discharge performing portion and the second preliminary discharge performing portion, wherein the first preliminary discharge performing portion is a portion where recovery means for executing recovery processing for the printhead near a home position of the printhead is arranged, and the second preliminary discharge performing portion is set on a side opposite to the first preliminary discharge performing portion in the scanning area of the carriage, and said preliminary discharge portion setting means makes setting for the first printhead to perform the preliminary discharge only at the first preliminary discharge performing portion, and makes setting for the second printhead to perform the preliminary discharge at the combination of positions set by said preliminary discharge portion setting means, in accordance with the scanning speed of the carriage in a set printing mode.

3. An inkjet printing apparatus which performs printing by bi-directionally scanning, over a printing medium, a carriage on which an inkjet printhead for discharging ink is mounted, the carriage being scanned at different scanning speeds in respective printing modes, the apparatus comprising:

preliminary discharge means for performing preliminary discharge;

a control unit configured to control the preliminary discharge operation by said preliminary discharge means; and first and second preliminary discharge receiving portions which receive ink discharged from the printhead by the preliminary discharge operation within a scanning area of the carriage, wherein said first preliminary discharge receiving portion has absorbing means for absorbing ink discharged in the preliminary discharge and said control unit causes said preliminary discharge means to execute the preliminary discharge operation at the first and second preliminary discharge receiving portions in a case that the scanning speed of the carriage is not more than a predetermined speed, and causes said preliminary discharge means to execute the preliminary discharge operation at the first preliminary discharge receiving portion in a case that the scanning speed of the carriage is higher than the predetermined speed.

* * * * *